US005865653A

United States Patent [19]

Okada et al.

[11] Patent Number: 5,865,653

[45] **Date of Patent: *Feb. 2, 1999**

[54] CONNECTOR

[75] Inventors: Naohisa Okada; Toshifumi Miyamoto, both of Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 529,091

[22] Filed: Sep. 15, 1995

[30] Foreign Application Priority Data

Nov. 7, 1994 [JP] Japan ..... 6-298931

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 5,120,269 | 6/1992 | Endo et al. | 439/752 |
| 5,292,262 | 3/1994 | Endo et al. | 439/752 |
| 5,460,550 | 10/1995 | Okayasu et al. | 439/752 |

FOREIGN PATENT DOCUMENTS

| | | |
|---|---|---|
| 0596707 | 5/1994 | European Pat. Off. . |
| 6151002 | 5/1994 | Japan . |
| 2237457 | 5/1991 | United Kingdom . |
| 8501128 | 6/1985 | WIPO . |

*Primary Examiner*—Gary F. Paumen

*Attorney, Agent, or Firm*—Jordan B. Bierman; Bierman, Muserlian and Lucas

[57] ABSTRACT

A connector has a retainer (3) which is slidable on a connector housing (2) while maintaining a given relation of position to the housing (2). In this connector, the retainer (3) is provided on a face opposed to the housing (2) with a hook like bend guide rib (21) which extends in a width direction. The guide rib (21) is provided on an outer surface of its distal end with a down slant guide face (27) adapted to engage with the guide face (23). When the retainer is attached to the housing (2) in a retracted position, the guide faces (23, 27) are spaced away from each other. When the retainer (3) is slid to an advanced position on the housing (2), the guide faces (23, 27) engage with each other, thereby bringing the retainer (3) into the advanced position while preventing the retainer (3) from floating up.

1 Claim, 7 Drawing Sheets

CONNECTOR

BACKGROUND OF THE INVENTION (1) Field of the Invention

This invention relates to a connector having retainers which serve to double lock terminal metal fixtures in a connector housing.

(2) Statement of the Prior Art

For convenience of explanation, a conventional connector having retainers will be described below by referring to FIGS. 14 to 17.

FIG. 14 is an exploded longitudinal sectional view of a conventional female connector, illustrating retainers which are provided apart from the connector. FIG. 15 is a longitudinal sectional view of the female connector in which the retainers are attached in a retracted position. FIG. 16 is a longitudinal sectional view of the female connector shown in FIG. 14 in which the retainers are attached in an advanced position. FIG. 17 is a longitudinal sectional view of the female connector shown in FIG. 14 in which a latch of each retainer could not be inserted into each cavity.

As shown in FIG. 14, a conventional connector comprises a housing a provided with a plurality of juxtaposed cavities b and a pair of retainers c each of which is attached to each of upper and lower surfaces of the housing a. Each retainer c has a side plate d on opposite lateral ends so that the side plates bridge the housing a laterally and has a latch f adapted to fit in each cavity b through a window e formed in each of upper and lower walls of the housing a.

The retainers c are attached to the housing a in a retracted position shown in FIG. 15 from a detached position shown in FIG. 14. In the retracted position, the latch f of each retainer c is disposed in the window e in the housing a, so that the terminal metal fixture can be inserted into and detached from the cavity b. Under this state, when the terminal metal fixture is inserted into the cavity b until the fixture engages with a lance g on a bottom wall of the cavity b, the fixture is temporarily locked in the cavity b. Then, the retainer c is slid to an advanced position shown in FIG. 16 in a down slant direction shown by an arrow in FIG. 15 while a bottom face h of the side plate d of the retainer c contacts with a guide face on a side end of the housing a. When the latch f enters the cavity b, the terminal metal fixture is regularly or double locked in the cavity b.

However, the retainer c which is used in such a connector tends to bulge in the lateral direction of the housing a, since the retainer c is short in length and long in width. Consequently, when the retainer c is slid on the housing a from the retracted position shown in FIG. 15 to the advanced position shown in FIG. 16, a center portion of the retainer c comes up from the housing a in the width direction, so that the latch f cannot enter the cavity b and rides on an edge of the window e. If such a failure is overlooked, a force by which the retainer c holds the terminal metal fixture will weaken, since the latch f cannot lock the fixture. If such a failure is found, it is possible to reset the retainer c. However, this requires much time and effort and results in a lowering of production efficiency.

Such a problem will occur in a connector wherein retainers are united through hinges to a housing.

SUMMARY OF THE INVENTION

An object of the present invention is to provide a connector in which a retainer can slide on a housing while maintaining a given relative position with respect to the housing.

In order to achieve the object, a connector in accordance with the present invention comprises: a housing including a plurality of juxtaposed cavities adapted to accommodate each terminal metal fixture, each cavity being provided with a window communicated with an outer surface of the housing; a retainer detachably attached to each of upper and lower portions of the housing to cover an outer surface on each portion in a width direction, the retainer being slidably between a retracted position and an advanced position, the retainer being provided with a latch which fits in each cavity through each window in the advanced position to prevent each terminal metal fixture from coming out of the cavity; and a guide mechanism for permitting the retainer to slide on an inner side of the housing while maintaining a given relative position between the retainer and housing.

The guide mechanism may interconnect the retainer and housing from the retracted position of the retainer.

The guide members of the housing in the guide mechanism clamp guide members of the retainer in the guide mechanism with no play when the retainer is slid into the advanced position.

In the connector of the present invention, the retainer can slide on the housing by means of the guide mechanism while maintaining a given relative position to the housing over the entire width of the retainer, when the retainer moves from the retracted position to the advanced position.

The retainer can smoothly slide to the regular advanced position on the housing, since the guide mechanism interconnects the guide members of the retainer and housing when the retainer is attached to the retracted position on the housing.

When the retainer slides on the housing from the retracted position to the advanced position, the guide member of the housing can grip the guide member of the retainer with no play.

According to the present invention, since it is possible to move the retainer to the advanced position on the housing while maintaining the retainer in a regular posture over the entire width, the latch can surely lock the terminal metal fixture, thereby firmly holding the fixture to carry out an attaching task of the retainer over again and enhance work efficiency.

The retainer can move smoothly from the retracted position to the advanced position on the housing.

It is possible to prevent the retainer from coming up from and causing any plays in the housing.

DETAILED DESCRIPTION OF THE PREFERRED EMBODIMENTS

An embodiment of a connector of the present invention will be described below by referring to FIGS. 1 to 13.

Figure 1:
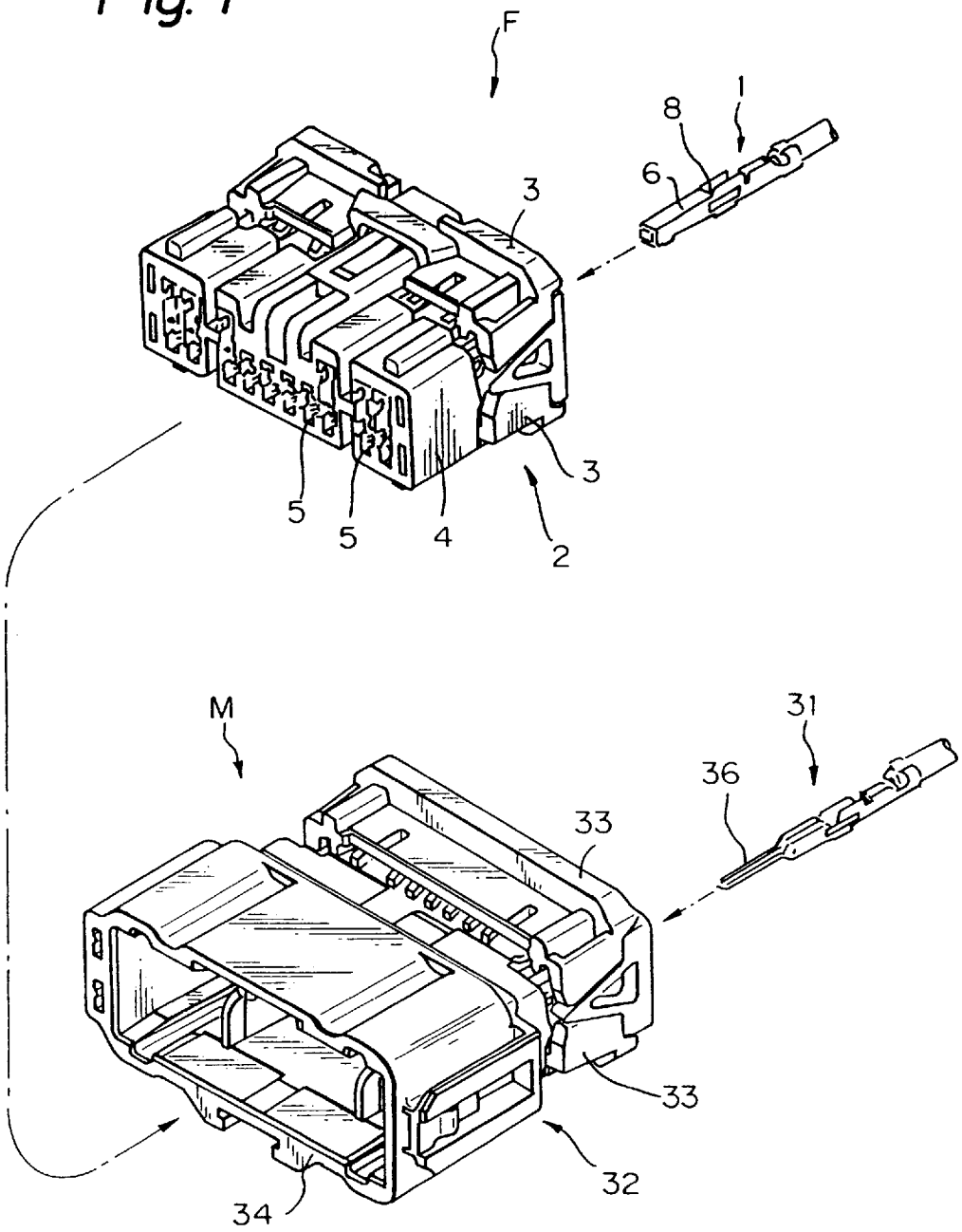
FIG. 1 is an exploded perspective view of an embodiment of a pair of female and male connectors.

In this embodiment, FIG. 1 shows a female connector F and a male connector M, which are coupled to each other. The female and male connectors F and M comprise: housings 2 and 32 which accommodate a female terminal metal fixture 1 and a male terminal metal fixture 31, respectively; and two pairs of retainers 3, 3 and 33, 33 which are attached to the housings 2 and 32 to double lock the terminal metal fixtures 1 and 31, respectively. Since attaching portions of the retainer in the female and male connectors F and M have the same structures, only the female connector F will be described below.

Figure 2:
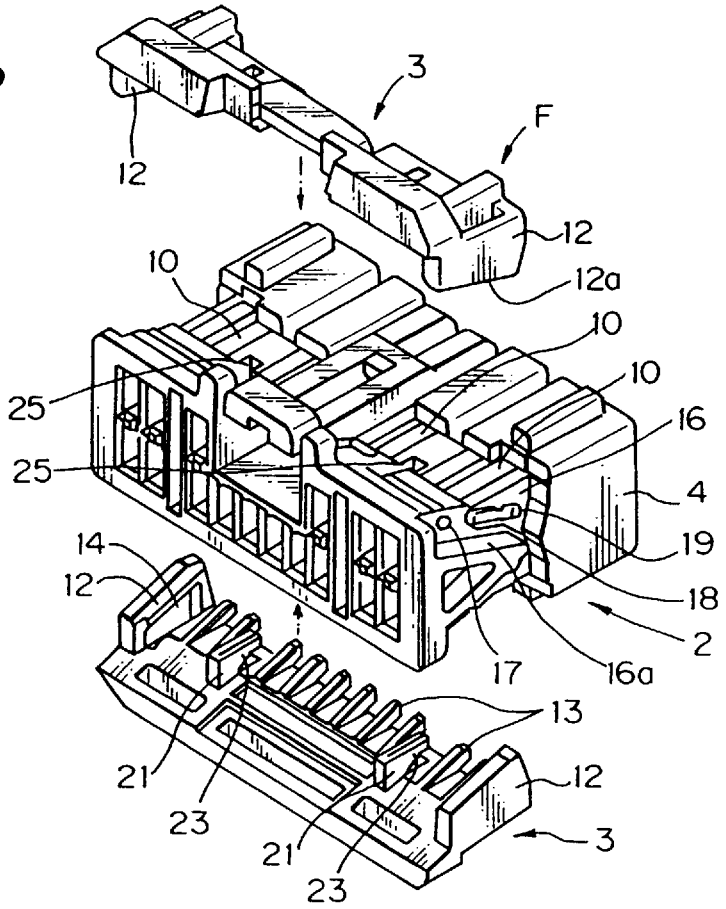
FIG. 2 is an exploded perspective view of a female connector, illustrating retainers in a detached position from the connector.
Figure 5:
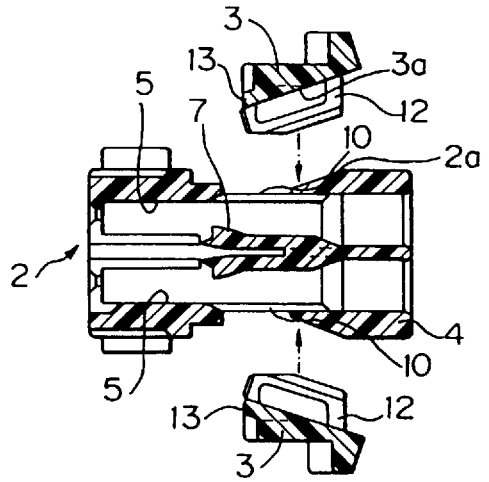
FIG. 5 is an exploded longitudinal sectional view of the female connector, illustrating an engaging portion for a terminal metal fixture on each retainer which is in the detached position from the connector.

As shown in FIG. 2, the housing 2 of the female connector F is made of a synthetic resin material and is provided in its front part (right side in the drawing) with a fitting portion 4 which is adapted to be coupled in a box like body 34 of the housing 32 of the mating male connector M. The housing 2 is provided in upper and lower rows with a plurality of cavities 5 which are open in the front and rear sides of the housing 2, as shown in FIG. 5. The female terminal metal fixture 1 is inserted into each cavity 5 through the rear side (right side in FIG. 5). The female terminal metal fixture 1 is provided on its distal end with a connection box 6 adapted to receive a tab 36 of the mating male terminal metal fixture 31, as shown in FIG. 1. The connection box 6 is provided in a side wall with an engaging hole (not shown) which engages with a resilient lance 7 (see FIG. 5) formed in each cavity 5. The female metal fixture 1 is also provided on a side wall opposed to the side wall having the engaging hole with a jaw 8 which is adapted to engage with a latch 13 (described hereinafter) of the retainer 3.

As shown in FIGS. 2 and 5, the housing 2 is provided on each of upper and lower walls behind the fitting portion 4 with an elongated window 10 with a given length. Each window 10 is communicated with each cavity 5. The window 10 serves to introduce the latch 13 of the retainer 3 into the cavity 5 so as to lock the female terminal metal fixture in the cavity 5 when the retainer 3 reaches the advanced position described hereinafter.

Each retainer 3 is attached to the upper and lower walls of the housing 2. The retainer 3 is made of a synthetic resin material and is provided on its opposite side ends with a side plate 12 so that the retainer 3 can bridge the housing 2 laterally. A face 3*a* on the retainer 3 which is opposed to each of the upper and lower walls of the housing 2 is formed into a down slant face while a mounting face 2*a* on the housing 2 which is opposed to the face 3*a* is formed into a down slant face. The retainer 3 is provided on its distal end of the face 3*a* with the latch 13 which is disposed in association with each cavity 5 so as to enter the cavity 5 through the window 10. The latch 13 is disposed in the window 10 and is not inserted in the cavity 5 when the retainer 3 is put on the retracted position 3. Thus, the female terminal metal fixture 1 can be inserted into and detached from the cavity 5. On the contrary, when the retainer 3 is slid to the advanced position, each latch 13 enters the cavity 5 deeply while the latch 13 slides under the front edge around the window 10. Consequently, the latch 13 fits in the jaw 8 of the female terminal metal fixture 1 accommodated in the cavity 5.

Figure 7:
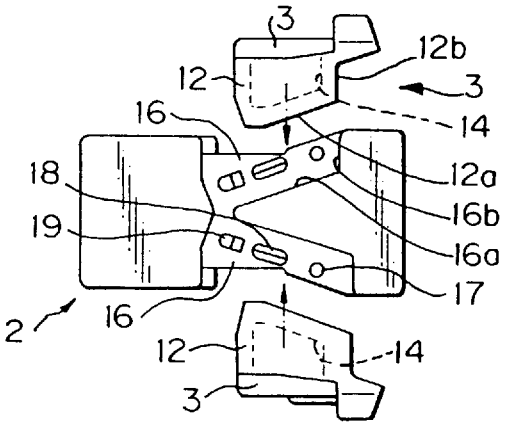
FIG. 7 is an exploded side elevational view of the female connector, illustrating holding portions on the opposite ends of each retainer in the detached position.

As shown in FIGS. 2 and 7, the side plate 12 on each of the opposite lateral ends of the retainer 3 is provided on the rear side with a fitting groove 14 which has a bottom face 12*a* and a given width. On the other hand, the housing 2 is provided on its opposite sides with a recess 16 in which the side plate 12 of the retainer 3 is fitted. A bottom face 16*a* in the recess 16 is formed into a given down slant face so as to guide the bottom face 12*a* in the side plate 12.

Each recess 16 is provided on the bottom face 16*a* with first to third projections 17 to 19 which serve to hold the retainer 3 in the retracted and advanced positions. Each projection is arranged in each recess 16 symmetrically with respect to a longitudinal center line of the housing 2 (see FIG. 7). The first projection 17 is a semi-circular shape, the second projection 18 is an elongated circular shape and is provided with a slant face on the front side or inlet side for the retainer 3, and the third projection 19 is a shortened elliptic shape and is provided with a slant face at a side adjacent the second projection 18.

The first and second projections 17 and 18 fit firmly in the groove 14 in the side plate 12 while the second and third projections 18 and 19 fit firmly in the groove 14. The retainer 3 is maintained with no play in the retracted position on the housing 2 by making a firm fitting between the first and second projections 17 and 18 and the groove 14. When the side plates 12 are slid on the bottom face 16*a* in the recess 16, the first projection 17 comes out of the groove 14 and the third projection 19 enters the groove 14. Then, the retainer 3 is held with no play in the advanced position by making a firm fitting between the second and third projections 18 and 19 and the groove 14.

Figure 6:
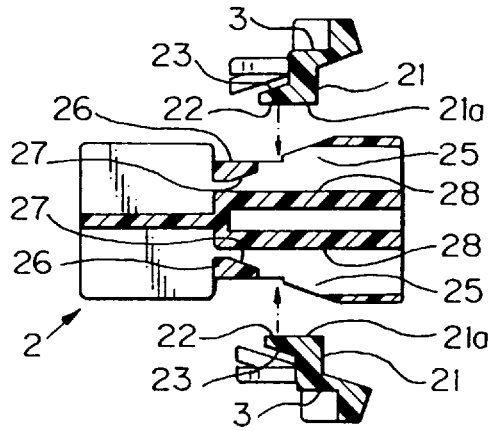
FIG. 6 is an exploded longitudinal sectional view of the female connector, illustrating a guide portion of each retainer in the detached position.

As shown in FIGS. 2 and 6, each retainer 3 is provided on the face opposed to the housing 2 with a pair of guide ribs 21 which extend inside the width of the retainer 3. Each guide rib 21 is formed into a hook like shape having a bend portion 22 at the distal end which projects forwardly from the bottom wall of the retainer 3. The bend portion or hook 22 is provided on its outside with a down slant face, which becomes a guide face 23 on the retainer 3.

On the other hand, the housing 2 is provided on each of upper and lower walls with an opening 25 which is adapted to receive each guide rib 21 slidably in the longitudinal direction. Each opening 25 is provided on its front edge with a latch 26 underneath which the hook 22 of the guide rib slides. The latch 26 is provided on its inner side with a slant guide face 27 which has the same inclination as that of the guide face 23 of the guide rib 21.

Figure 9:
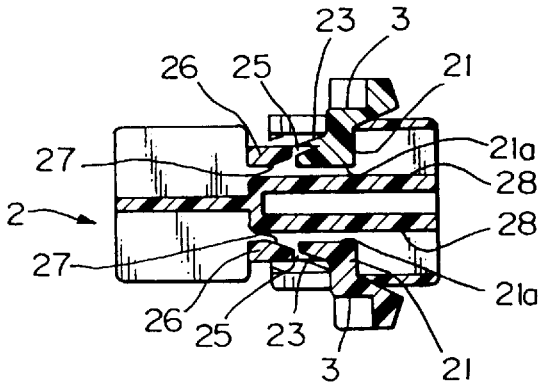
FIG. 9 is a longitudinal sectional view of the female connector shown in FIG. 8, illustrating the guide portion of each retainer in the retracted position on the connector.

When the retainer 3 is maintained in the retracted position, the guide faces 23 and 27 on the retainer 3 and housing 2 are spaced a little from their end edges, as shown in FIG. 9. When the retainer 3 is moved from the retracted position to the advanced position, the guide ribs 21 are introduced into the cavity 5 while the guide face 23 on the hook 22 contacts with the guide face 27 on the latch 26.

Figure 12:
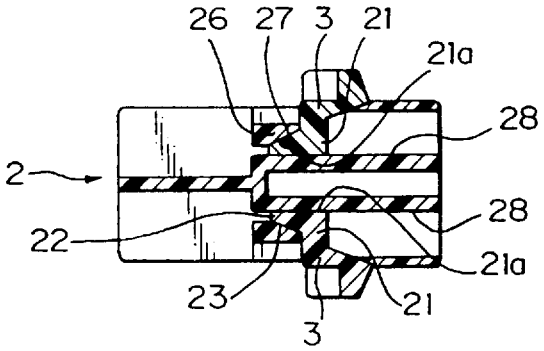
FIG. 12 is a longitudinal sectional view of the female connector shown in FIG. 11, illustrating the guide portion of each retainer in the advanced position on the connector.

Each opening 25 is provided on its lower side (interior in the housing 2) with a bearing face 28 which receives an inner end edges 21*a* of the guide ribs 21 and is flat and parallel to a longitudinal center line of the housing 2. On the other hand, the inner end edges 21*a* of the guide ribs 21 as shown in FIG. 12 are straight so that the edges 21*a* can make a plane contact with the bearing face 28 when the retainer is moved to the advanced position so that the hooks 22 of the guide ribs 21 slide underneath the latch 26. When the retainer 3 is slid to the advanced position, the hooks 22 of the guide ribs 21 slide underneath the latch 26 and the straight end edges 21*a* contact with the bearing face 28, so that the hooks 22 are clamped between the latch 26 and the bearing face 28. Thus, it is possible to suppress the plays between the retainer 3 and the housing 2 as well as to prevent the retainer 3 from coming up from the housing 2.

Next, an operation of the connector having the above structure will be explained below.

Figure 3:
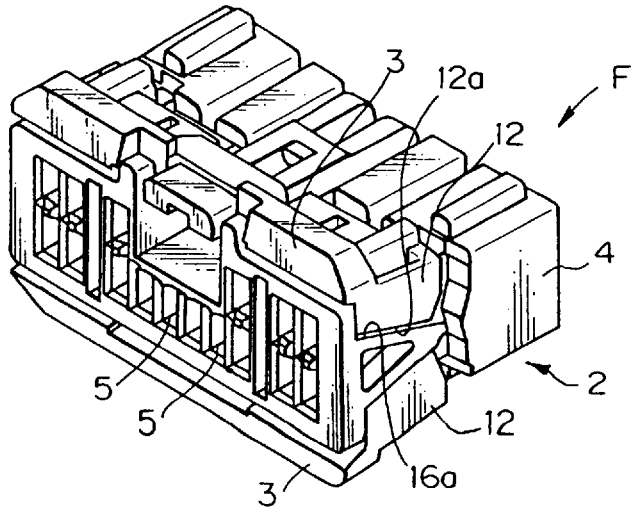
FIG. 3 is a perspective view of a female connector, illustrating the retainers in a retracted position on the connector.
Figure 10:
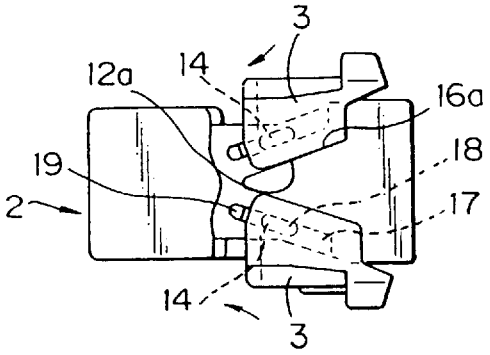
FIG. 10 is a side elevational view of the female connector, illustrating the holding portions on the opposite ends of each retainer in the retracted position on the connector.

First, a pair of retainers 3 are attached to the upper and lower walls of the housing 2 from the position shown in FIG. 2 and FIGS. 5 to 7, respectively. In this case, each retainer 3, as shown in FIG. 7, is pushed so that a rear edge 12*b* of the side plate 12 contacts with a rear edge 16*b* of the recess 16 in the housing 2. The side plate 12 of each retainer 3 are pushed onto the housing 2 and resiliently deformed while the side plate 12 rides over the first and second projections 17 and 18. As shown in FIG. 10, when the bottom face 12*a* of the side plate 12 contacts with the bottom face 16*a* in the recess 16, the first and second projections 17 and 18 are firmly fitted in the groove 14, thereby maintaining the retainer 3 in the retracted position, as shown in FIG. 3.

Figure 8:
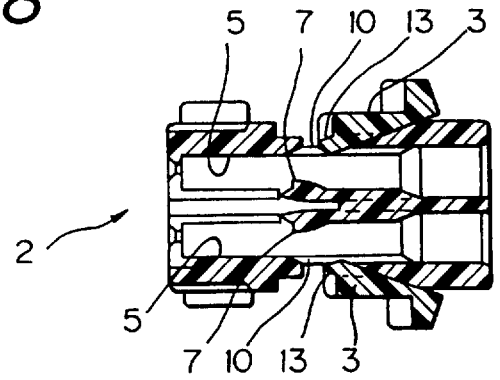
FIG. 8 is a longitudinal sectional view of the female connector in which the retainers are attached in the retracted position.

At the time, the latch 13 of the retainer 3, as shown in FIG. 8, still dwells in the window 10 and does not enter the cavity 5. On the other hand, the guide rib 21, as shown in FIG. 9, enters the opening 25 while the guide faces 23 and 27 on the retainer 3 and housing 2 approach their end edges.

Thus, each female terminal metal fixture 1 is inserted into each cavity 5 in the housing 2, as shown in FIG. 1, when the retainer 3 is maintained in the retracted position. The inserted female terminal metal fixture 1 is temporarily locked in the cavity 5 since the lance 7 in the cavity 5 engages with the hole in the fixture 1.

Next, each retainer is slid in the direction on the arrow in FIG. 10 so that the bottom faces 12*a* of the side plates 12 slide on the bottom faces 16*a* in the recess 16. Immediately after the sliding action has started, the guide ribs 21 engage with the guide faces 23 and 27 on the latch 26 and the retainer 3 is precisely moved to the advanced position on the guide faces 23 while the retainer 3 is suppressed from coming up from the housing 2 in the width direction.

Since the guide ribs 21 strike the latch 26 by their distal ends in the case that the retainer 3 comes up from the housing 2 in the width direction, the retainer 3 cannot advance further. However, if the retainer 3 is slid again while being pushed toward the housing 2, the guide faces 23 engage with the guide faces 27 in the manner described above and the retainer can be precisely moved to the advanced position along the faces 23 and 27.

Figure 11:
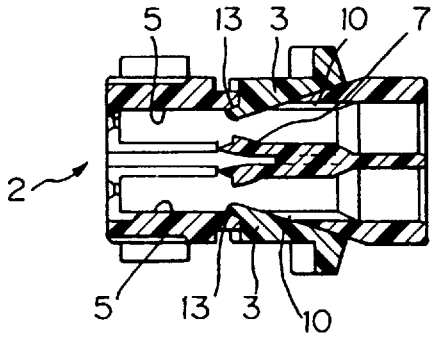
FIG. 11 is a longitudinal sectional view of the female connector, illustrating the guide portion of each retainer in the advanged position on the connector.
Figure 13:
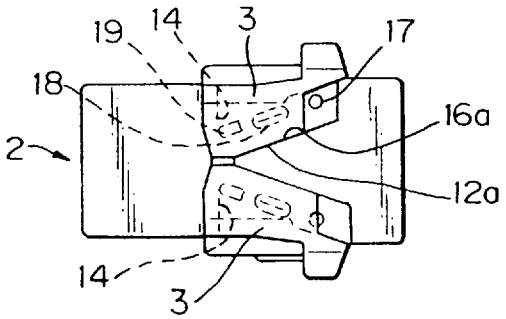
FIG. 13 is a side elevational view of the female connector shown in FIG. 11, illustrating the holding portions on the opposite ends of each retainer in the advanced position on the connector.
Figure 14:
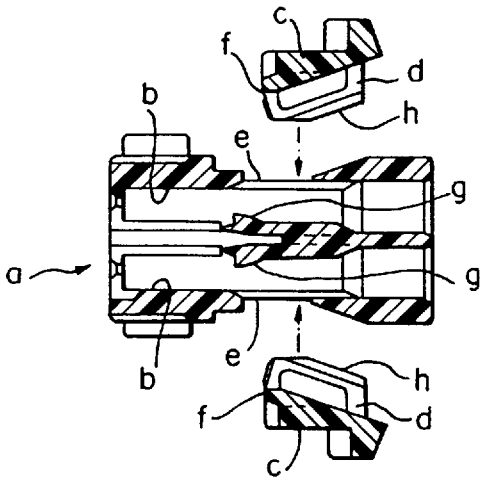
Fig. 14 PRIOR ART
FIG. 14 is an exploded longitudinal sectional view of a conventional female connector, illustrating retainers which are provided apart from the connector.
Figure 15:
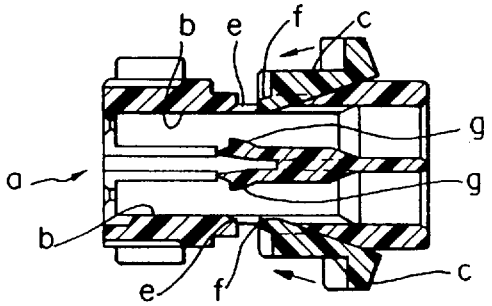
Fig. 15 PRIOR ART
FIG. 15 is a longitudinal sectional view of the female connector in which the retainers are attached in a retracted position.
Figure 16:
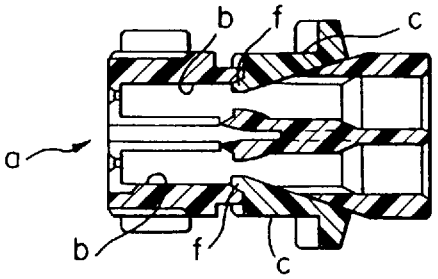
Fig. 16 PRIOR ART
FIG. 16 is a longitudinal sectional view of the female connector shown in FIG. 14 in which the retainers are attached in an advanced position.
Figure 17:
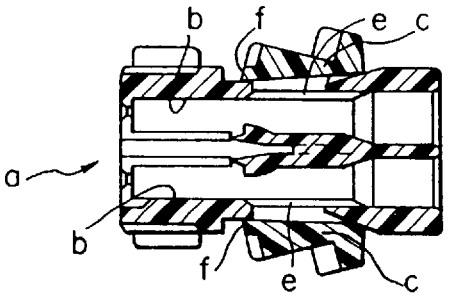
Fig. 17 PRIOR ART
FIG. 17 is a longitudinal sectional view of the female connector shown in FIG. 14 in which a latch of each retainer could not be inserted into each cavity.

When the retainer 3 is moved to the advanced position, as shown in FIG. 13, the first projection 17 comes out of the groove 14 in the side plate 12 and the third projection 19 enters the groove 14. Thus, the second and third projections 18 and 19 fit in the groove 14, thereby holding the retainer 3 without causing any plays in the advanced position. As shown in FIG. 11, the latch 13 of the retainer 3 enters the cavity 5 deeply and engages with the jaw 8 of the female terminal metal fixture 1 accommodated in the cavity 5, thereby double locking the fixture 1 in the cavity 5.

As shown in FIG. 12, the bend portions or hooks 22 of the guide ribs 21 moves to the inside of the latch 26 of the housing 2 and the straight end edge 21*a* contacts with the bearing face 28 on the housing 2, so that the hooks 22 are clamped between the guide face 27 and the bearing face 28. Consequently, the retainer 3 is prevented from coming up from the housing 2 even after the retainer 3 has moved to the advanced position and is maintained there with no play.

Figure 4:
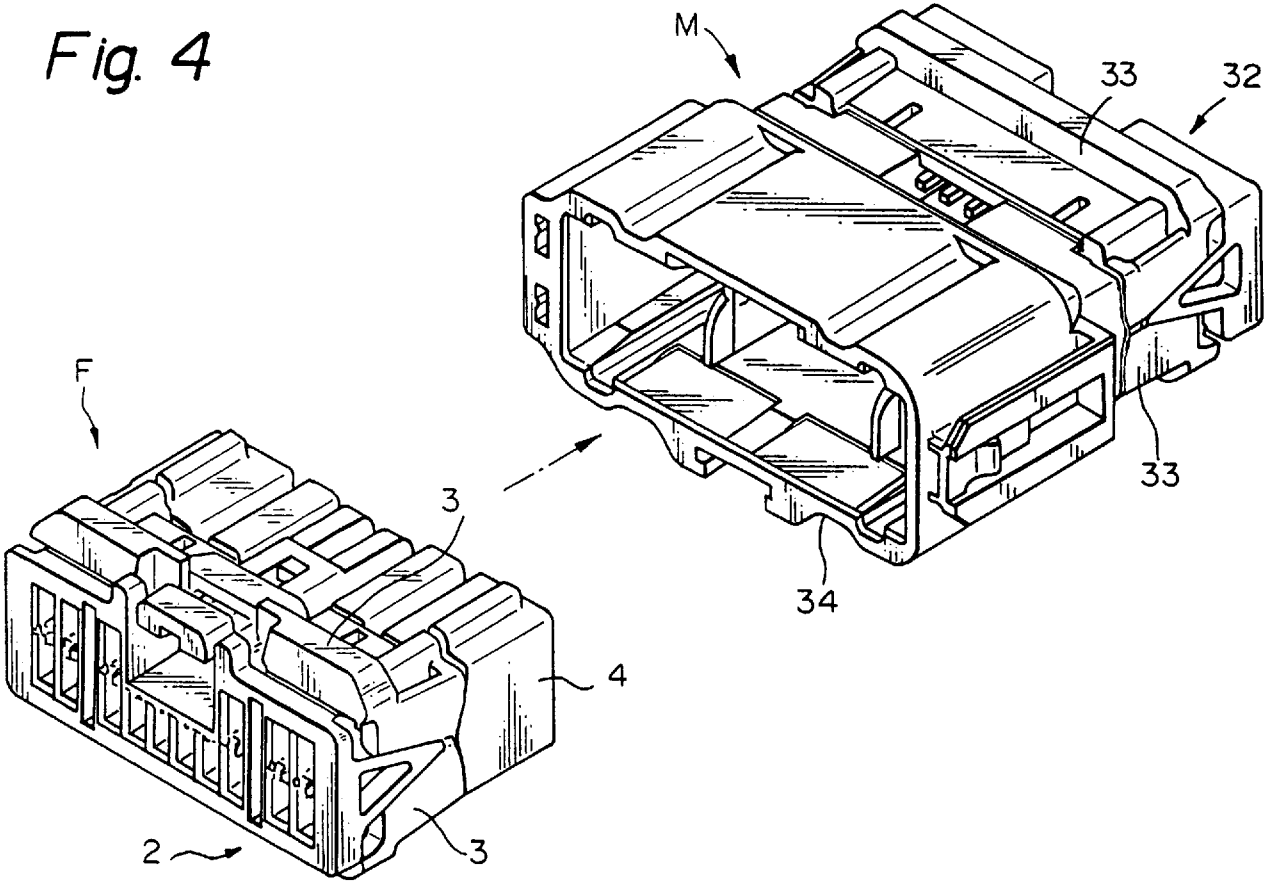
FIG. 4 is an exploded perspective view of a pair of female and male connectors, illustrating the retainers in an advanced position on the connectors.

In the other male connector M, retainers 33 are attached to a housing 32 in the same manner as the female connector F described above to double lock male terminal metal fixtures 31. As shown in FIG. 4, the female and male connectors F and M are interconnected after the retainers 3 and 33 have been maintained in the advanced positions.

According to this embodiment, since the retainer 3 can be moved from the retracted position to the advanced position while suppressing the retainer 3 from coming up from the housing 2, the latch 13 enters the cavity 5 surely without riding on the outer face on the housing 2, thereby locking the female terminal metal fixtures 1. That is, it is possible to firmly hold the female terminal metal fixtures 1 in the housing 2, to eliminate a task of remounting the retainer 3 on the housing 2, and to enhance work efficiency.

When the retainer 3 is in the advanced position, the hooks 22 of the guide ribs 21 are clamped between the guide faces 27 and the bearing face 28, so the retainer 3 cannot move on the housing 2. Thus, it is possible to surely prevent the retainer 3 in the advanced position from coming up from the housing 2. This advantage will be also obtained by the male connector M.

In the above embodiment, the guide faces 23 and 27 on the retainer 3 and housing 2 approach their end edges when the retainer 3 is maintained in the retracted position. However, if the guide faces 23 and 27 are engaged with their end edges when the retainer 3 is attached to the housing 2 in the retracted position, the retainer 3 can move to the advanced position more smoothly.

Although the retainers are separated from the housing in the above embodiment, the retainers may be united to the housing through hinges. Heretofore, such a hinge type retainer intends to come up from the housing. The present invention, however, can move the retainer to the advanced position regularly.

What is claimed is:

1. A connector comprising a housing, including a plurality of juxtaposed cavities each adapted to accommodate each terminal metal fixture, each of said cavities having a window communicating with an outer surface of said housing;

a retainer, detachably attached to each of an upper portion and a lower portion of said housing, thereby to cover an outer surface of the respective portion in a width direction, said retainer provided with guide ribs being slidable in a retainer direction between a retracted position and an advanced position, said retainer having a latch separate from said guide ribs, which fits in each of said cavities through each said window when said retainer is in said advanced position, thereby preventing each said terminal metal fixture from coming out of said cavity;

a guide mechanism permitting said retainer to slide on an inner side of said housing while maintaining a predetermined relative position between said retainer and said housing, said guide mechanism comprising said ribs, a hook with a first guide face on each of said ribs, a second guide face on said housing complementary to said first guide surface when said retainer is in said advanced position, a bearing face on said housing extending in said retainer direction, an inner end edge of said rib bearing against said bearing face when said retainer is in said advanced position, whereby said hook is clamped between said second guide face and said bearing and face.

* * * * *